US006806657B2

(12) United States Patent
Rudolph et al.

(10) Patent No.: US 6,806,657 B2
(45) Date of Patent: Oct. 19, 2004

(54) DEVICE FOR OPERATING DISCHARGE LAMPS

(75) Inventors: Bernd Rudolph, Forstern (DE); Harald Schmitt, München (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/695,782

(22) Filed: Oct. 30, 2003

(65) Prior Publication Data

US 2004/0090193 A1 May 13, 2004

(30) Foreign Application Priority Data

Nov. 13, 2002 (DE) ..... 102 52 836

(51) Int. Cl.[7] ..... H05B 37/00
(52) U.S. Cl. ..... 315/276; 315/105; 315/221

(58) Field of Search ..... 315/276, 221, 315/105, 224, 106

(56) References Cited

U.S. PATENT DOCUMENTS 4,392,085 A * 7/1983 Knoll et al. ..... 315/173
4,547,705 A * 10/1985 Hirayama et al. ..... 315/219

* cited by examiner

*Primary Examiner*—David Vu

(57) ABSTRACT

A device for operating a plurality of discharge lamps (71, 72) is to be fashioned cost effectively. Two lamps (71, 72) are therefore operated in a single load circuit. In the preheating phase, the incandescent filaments (711, 712, 721, 722) are supplied with preheating current either directly or via a transformer ($L_s$, $L_p$). The preheating current is controlled via a temperature-dependent resistor (PTC) in such a way that the continuous heating current is greatly reduced over all the filaments during the operation of the lamp.

7 Claims, 2 Drawing Sheets

-- PRIOR ART --

-- PRIOR ART --

-- PRIOR ART --

-- PRIOR ART --

DEVICE FOR OPERATING DISCHARGE LAMPS

FIELD OF THE INVENTION

The present invention relates to a device for operating at least two discharge lamps, having a current control device for controlling the current through the incandescent filaments. In particular, the present invention relates to electronic ballasts in which such a device is integrated. Operating discharge lamps comprises in this case both their starting and their being alight.

BACKGROUND OF THE INVENTION

It is known to operate two discharge lamps with two load circuits. In this case the term load circuit refers to the load of a bridge that is used as an inverter to operate a discharge lamp. Each load circuit has a dedicated preheating arrangement for the respective lamp. Furthermore, according to the internal prior art it is possible to operate two lamps in one load circuit. Here, the primary coil of a heating transformer of a series circuit of two lamps is connected in parallel and the secondary coil of the heating transformer is connected between the two lamps. Furthermore, it is possible to heat all the filaments of the lamps by transformer via secondary windings, the primary winding being situated in a section of the bridge suitable for the application.

It is relatively complicated to implement the load circuits in terms of circuitry, since electronic control circuits with relay or transistor switches are required for a defined, sequential starting and subsequent joint operation of the lamps. By contrast, relatively favorable control circuits that use only passive components for controlling the preheating exist for the purpose of operating individual lamps. The essential constituent of such circuits is a heat-sensitive resistor with a positive temperature coefficient.

A bridge circuit with a relevant load circuit is illustrated in FIG. 1. The bridge is implemented for the purpose of inversion as a half bridge with two switching elements 1 and 2 and two capacitors 3 and 4. The load circuit 5 in the bridge comprises a coil 6 in series with a lamp 7 which is connected in parallel both with a resonance capacitor 8 and with a heat-sensitive resistor 9.

The mode of operation of the circuit illustrated in FIG. 1 may be explained as follows. By actuating the switches 1 and 2 suitably, an AC voltage for the load circuit 5 is generated in the center tap of the bridge from the DC voltage. The frequency of the AC voltage is advantageously in the region of the resonant frequency of the coil 6 and the capacitor 8 for the ignition process of the lamp. Before the ignition, as PTC thermistor the resistor 9 with a positive temperature coefficient (PTC) detunes the series resonant circuit 6, 8 in such a way that the required ignition voltage across the lamp 7 or the capacitor 8 is not reached. However, the current is already flowing through the incandescent filaments 10 and 11 of the lamp 7 such that they are preheated for the ignition process. In the meantime, current is likewise flowing through the PTC thermistor 9, which it heats in this preheating phase. Its resistance rises in the process, and so the detuning of the series resonant circuit, 6, 8 is correspondingly reduced such that the ignition voltage across the lamp 7 can be reached. The PTC thermistor 9 is designed in this case such that it carries a sufficient quantity of current even after ignition in order to remain highly resistant so that the resonance can be maintained at an appropriate level of quality.

For the sake of clarity, the load circuit 5 is illustrated in FIG. 2*a* without the coil 6. FIG. 2*b* shows a variant of the load circuit of FIG. 2*a*. Connected in series with the PTC thermistor 9 is a series capacitor 12 which has the effect that the detuning of the resonant circuit by the PTC thermistor 9 is not so marked as in the case of the circuit of FIG. 2*a*. This means that in this case the ignition voltage is reached more quickly and the lamp is ignited more rapidly as a consequence thereof.

A further variant of the load circuits that are illustrated in FIGS. 2*a* and 2*b* is reproduced in 2*c*. In this case, the series capacitor 12 is chiefly active in the cold state of the PTC thermistor 9, whereas the series circuit of the two capacitors 8 and 9 is only active in the warm state of the PTC thermistor 9, that is to say during the operation and ignition of the lamp.

SUMMARY OF THE INVENTION

The object of the present invention consists in proposing a cost effective preheating circuit for operating two lamps.

According to the invention, this object is achieved by means of a device for operating at least two discharge lamps having a first contact device for electrically connecting a first discharge lamp, which has two first incandescent filaments, a second contact device for electrically connecting a second discharge lamp, which has two second incandescent filaments and a current control device for controlling the current through the two first and two second incandescent filaments, wherein terminals of the first contact device for one of the first incandescent filaments are connected to terminals of the second contact device for one of the second incandescent filaments together with a secondary winding of a transformer device in the circuit, and wherein one terminal each of the first and second contact device for the respective other one of the first and second incandescent filaments are interconnected, with the interposition of the current control device, in series with the primary winding of the transformer device.

The advantage of the inventive circuit resides in that by comparison with the preheating circuit for one lamp the additional outlay for preheating a second lamp is present only in one component, specifically a transformer. Given suitable dimensioning, the transformer ensures that all the incandescent filaments of the discharge lamps are heated simultaneously and with approximately the same power.

In one advantageous refinement, a resonance capacitor is connected in parallel with the inventive device, that is to say between the remaining terminals of the two contact devices. The two lamps can thereby be operated with the aid of a resonant circuit.

The current control device advantageously comprises a PTC thermistor with a positive temperature coefficient. This component permits a relatively simple and cost-effective control of the preheating for the lamps. Instead of the PTC thermistors, the current control device can comprise a transistor. It is possible thereby to control the preheating in a more targeted but also more complicated way.

A series capacitor can be connected in series with the current control device; it has the effect that the resonant circuit is detuned less overall, and the lamps are ignited earlier by a corresponding increase in current.

A sequential starting capacitor can be provided in parallel with the first and/or second contact device; it can be used advantageously to control the sequential starting sequence in the case of at least two lamps. Consequently, it is possible to achieve sequential starting in order to avoid very high ignition currents/voltages being reached, said starting permitting the use of components which cannot be too highly loaded and are therefore more cost-effective.

Also, the device preferably can be connected to an inductor with the aid of which the device can be operated in resonance. The device can thereby be driven by a single inverter for the purpose of operating two or more lamps.

The inventive device is advantageously integrated in an electronic ballast for fluorescent lamps. It is thereby possible to operate two or more lamps with the aid of one ballast.

BRIEF DESCRIPTION OF THE DRAWINGS

The invention will now be explained in more detail with the aid of the attached drawings, in which.

DETAILED DESCRIPTION OF THE INVENTION

The embodiments described below constitute only preferred embodiments of the present invention.

Figure 1:
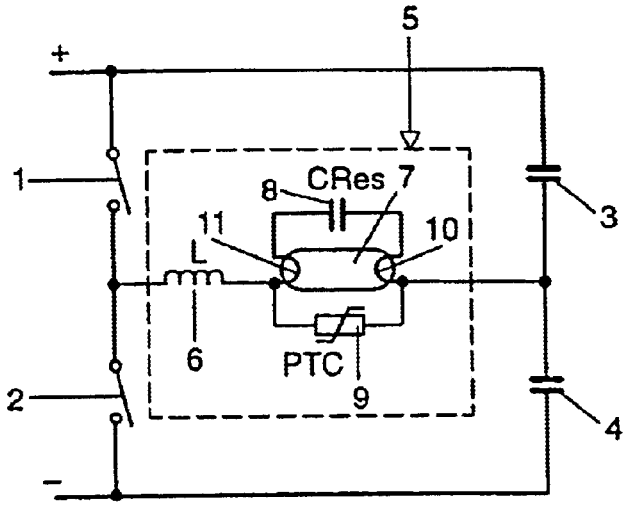
FIG. 1 shows a circuit diagram of a half bridge with a load circuit in accordance with the prior art, for operating a fluorescent lamp.
Figure 2A:
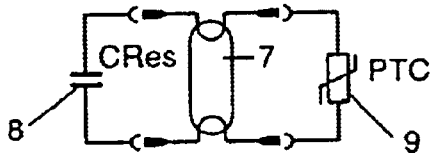
FIGS. 2*a,* 2*b,* 2*c* show variants of the load circuits in accordance with the prior art.
Figure 2B:
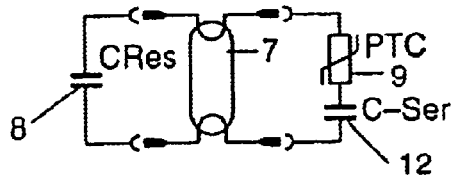
Figure 2C:
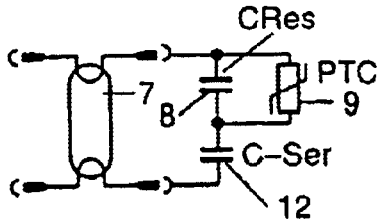
Figure 3:
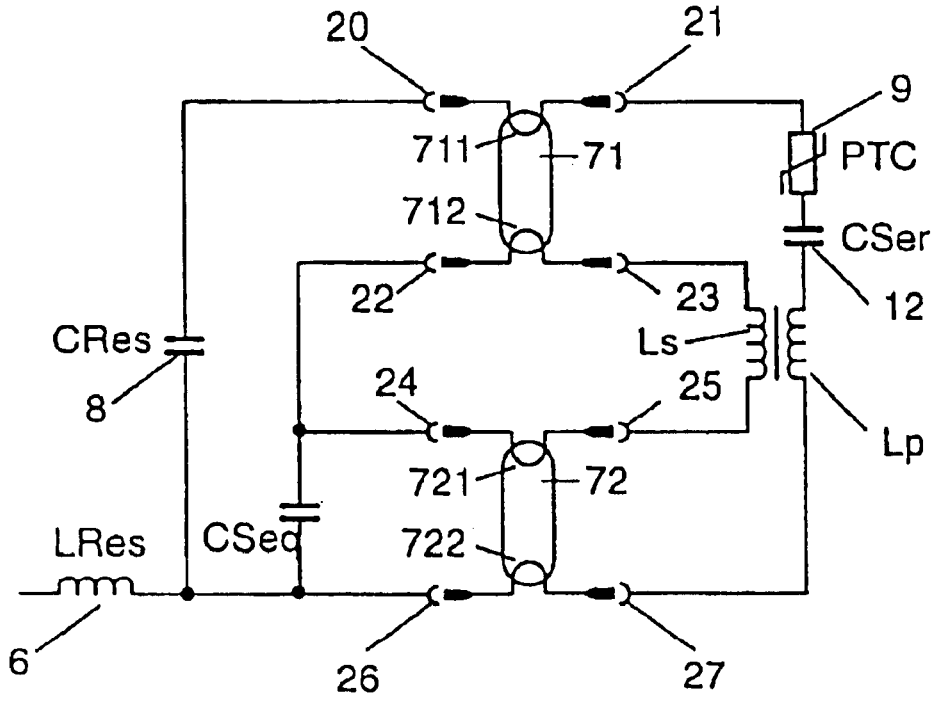
FIG. 3 shows an inventive load circuit for operating at least two lamps.

FIG. 3 illustrates an inventive load circuit of a ballast for discharge lamps. Lamps 71 and 72 are operated in the load circuit. They have in each case two incandescent filaments 711, 712 and 721, 722. The circuit provides the terminals 20 and 21 for the incandescent filament 711 of the lamp 71, the terminals 22 and 23 for the incandescent filament 712 of the lamp 71, the terminals 24 and 25 for the incandescent filament 721 of the lamp 72, and the terminals 26 and 27 for the incandescent filament 722 of the lamp 72.

A resonance capacitor $C_{res}$ 8 is connected between the terminals 20 and 26 of the two lamps 71 and 72. Furthermore, a resonance inductor $L_{res}$ 6 is connected to the terminal 26.

A thermistor PTC with a positive temperature coefficient, a series capacitor $C_{ser}$ and a primary coil $L_p$ of a transformer are connected in series between the terminals 21 and 27 of the lamps 71 and 72. The secondary coil Ls of the transformer is connected between the terminals 23 and 25 of the lamps 71 and 72. Furthermore, the terminals 22 and 24 of the two lamps are interconnected. Finally, a sequential starting capacitor $C_{seq}$ is connected between the terminals 24 and 26 of the lamp 72.

The mode of operation of the load circuit with the two lamps 71 and 72 may be explained in more detail below. In principle, the operation of the lamps 71 and 72 consists of the three phases: preheating the incandescent filaments, igniting the lamps and keeping the lamps alight. The energy is fed to the lamps via the resonant circuit $C_{res}$, $L_{res}$.

At the start of the preheating phase, the heat-sensitive thermistor PTC 9 is still cool and therefore of low resistance. In this case, it damps the load resonant circuit to such an extent that the voltage across the lamps 71, 72 does not suffice to ignite the lamps. The preheating current flows through the incandescent filament 711 and 722, thus also through the series circuit comprising the thermistor PTC 9, the series capacitor $C_{ser}$ and the primary winding $L_p$ of the transformer. Preheating current is coupled via the transformer into the circuit comprising the two incandescent filaments 712 and 721 and the secondary coil $L_s$. The transformer is advantageously to be dimensioned in this case such that the preheating current through the incandescent filaments 711 and 722 corresponds in terms of power to the preheating current through the incandescent filaments 712 and 721. A balanced preheating of all the incandescent filaments 711, 712, 721, 722 can thereby be achieved.

The series capacitor $C_{ser}$ is optionally connected into the load circuit. In the preheating phase, it assures an increase in current in the resonant circuit and thus an acceleration of the preheating phase.

The preheating current heats the thermistor PTC 9 such that the latter is of high resistance at the end of the preheating phase. Consequently, the damping of the load circuit is for the most part canceled, the quality of the resonant circuit, and thus the voltage across the lamps 71 and 72, rises and the two lamps are ignited.

The two lamps 71 and 72 are ignited sequentially in order to avoid an excessively high ignition current in the ignition phase. The sequential starting capacitor $C_{seq}$ is connected in parallel with the lamp 72 for this purpose. Since the lamps 71 and 72 constitute a voltage divider, because of the sequential starting capacitor $C_{seq}$ less voltage drops across the lamp 72 than across the lamp 71. Consequently, the lamp 71 is ignited before the lamp 72. This preheating time can be prescribed in a targeted fashion by suitable dimensioning of the sequential starting capacitor $C_{seq}$.

In the operating phase, in which the lamps 71 and 72 are of relatively low resistance, the current runs to the terminal 26 essentially from the terminal 20 via the incandescent filament 711, the incandescent filament 712, the terminal 22, the terminal 24, the incandescent filament 721, the incandescent filament 722. The continuous heating current during operation of the lamps is strongly reduced over all the filaments owing to the high resistance of the thermistor PTC and the current, thereby strongly reduced, via the thermistor PTC.

What is claimed is:

1. A device for operating at least two discharge lamps (71, 72), having a first contact device for electrically connecting a first discharge lamp (71), which has two first incandescent filaments (711, 712), a second contact device for electrically connecting a second discharge lamp, which has two second incandescent filaments (721, 722), and a current control device for controlling the current through the two first and two second incandescent filaments (711, 712, 721, 722), characterized in that terminals (22, 23) of the first contact device for one of the first incandescent filaments (712) are connected to terminals (24, 25) of the second contact device for one of the second incandescent filaments (721) together with a secondary winding ($L_s$) of a transformer device in the circuit, and in that one terminal (21, 27), each of the first and second contact device for the respective other one of the first and second incandescent filaments (711, 722) are interconnected, with the interposition of the current control device (9), in series with the primary winding ($L_p$) of the transformer device.

2. The device as claimed in claim 1, in which a resonance capacitor (8) is connected between the remaining terminals (20, 26) of the first and second contact device.

3. The device as claimed in claim 1, in which a series capacitor (12) for increasing the current for a preheating phase is connected in series with the current control device (9) and the primary winding ($L_p$) of the transformer device.

4. The device as claimed in claim 1, in which the current control device (9) comprises a PTC thermistor.

5. The device as claimed in claim 1, in which the sequential starting capacitor ($C_{seq}$) is connected in parallel with the first or second contact device.

6. The device as claimed in claim 1, in which there is connected to the device an inductor (6) with the aid of which the device can be operated in resonance in order to ignite the discharge lamps (71, 72).

7. An electronic ballast for operating discharge lamps (71, 72) having a device as claimed in claim 1.

* * * * *